United States Patent [19]

Lillybeck et al.

[11] 4,309,024

[45] Jan. 5, 1982

[54] CUPOLA WITH AUXILIARY GAS GENERATOR

[75] Inventors: Norman P. Lillybeck, Moline, Ill.; David E. Dell'Agnese, Milwaukee, Wis.

[73] Assignee: Modern Equipment Company, Port Washington, Wis.

[21] Appl. No.: 10,371

[22] Filed: Feb. 8, 1979

Related U.S. Application Data

[63] Continuation-in-part of Ser. No. 816,382, Jul. 18, 1977, abandoned.

[51] Int. Cl.[3] ..... F27B 1/20

[52] U.S. Cl. ..... 266/138; 48/76; 75/44 R; 266/160; 266/166; 266/186; 266/195; 266/900

[58] Field of Search ..... 266/197, 138, 140, 142, 266/155, 156, 159, 160, 166, 186, 187, 195, 198, 199; 75/43, 44 R, 44 S; 48/76, 197 R

[56] References Cited

U.S. PATENT DOCUMENTS

| | | | |
|---|---|---|---|
| B 375,220 | 1/1975 | Fernandes | 48/197 R |
| 1,578,648 | 3/1926 | Dyer | 75/43 |
| 1,836,005 | 12/1931 | Berry | 266/186 |
| 2,040,651 | 5/1936 | Frankl | 266/197 |
| 2,833,643 | 5/1958 | Newman . | |
| 3,454,395 | 7/1969 | Von Stroh et al. . | |
| 3,814,404 | 6/1974 | Claflin | 266/156 |
| 4,019,895 | 4/1977 | Santen | 75/38 |

FOREIGN PATENT DOCUMENTS

| | | | |
|---|---|---|---|
| 471454 | 2/1951 | Canada . | |
| 291258 | 5/1928 | United Kingdom | 266/166 |

*Primary Examiner*—M. J. Andrews
*Attorney, Agent, or Firm*—Meyer, Tilberry & Body

[57] ABSTRACT

A cupola for the melting of metal is provided with an auxiliary gas generator which supplies through the forehearth hot carbon monoxide rich gas to the bottom of the cupola as a source of heat. The heat of the gases maintains the cupola hearth and forehearth hot. Ordinary coal, or coke breeze or any other carbonaceous fuel may be burned in the generator. Additionally, the cupola may be allowed to go to zero output without cooling off.

5 Claims, 1 Drawing Figure

CUPOLA WITH AUXILIARY GAS GENERATOR

Figure 1:
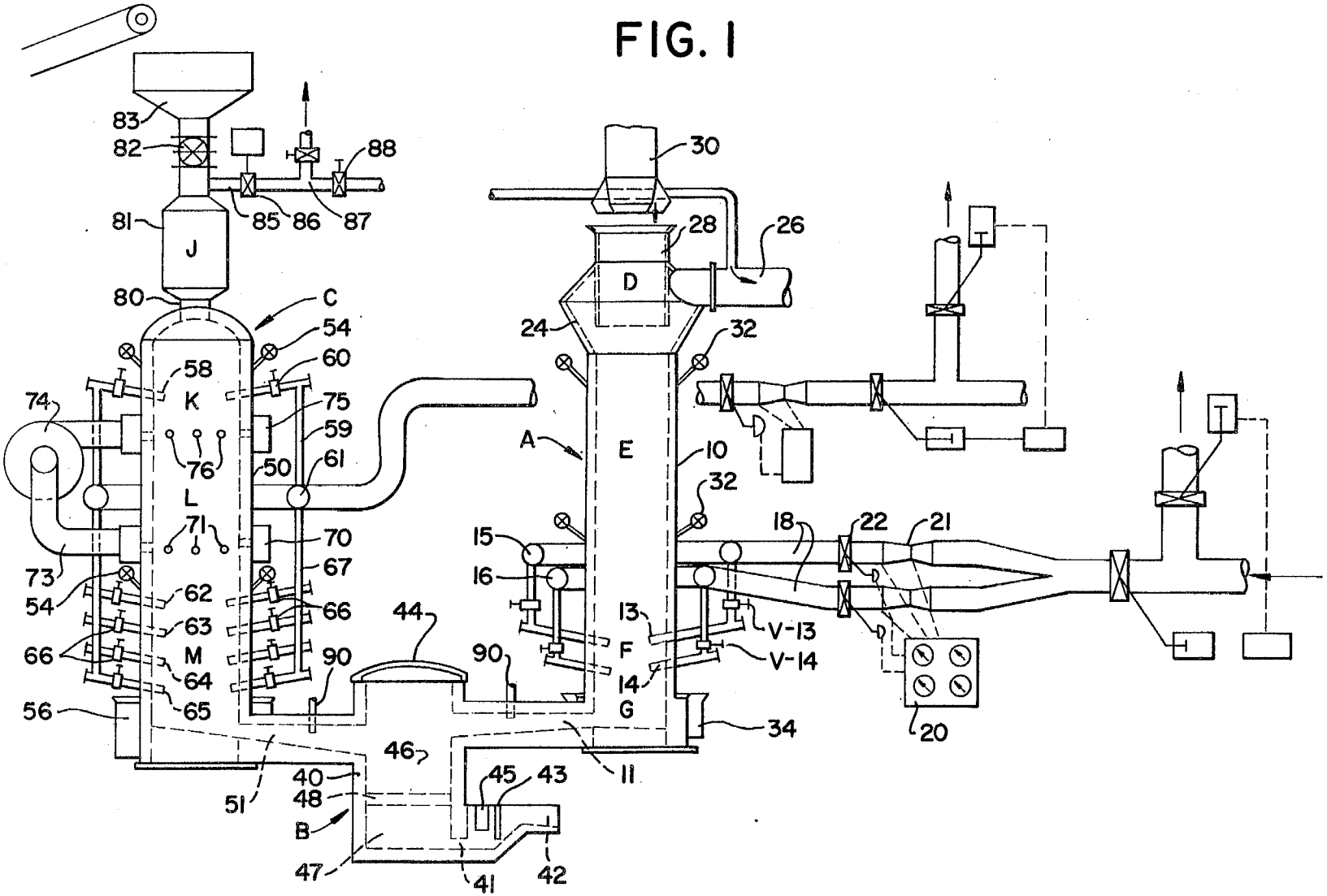

This is a continuation of application Ser. No. 816,382 filed July 18, 1977 now abandoned.

This invention pertains to the art of cupolas and more particularly to a cupola operating in combination with an auxiliary hot gas generator.

Cupolas used for melting of metal normally consist of a vertically extending, refractory lined, steel cylinder closed at the bottom. Coke, scrap metal and flux are fed into the cylinder either through an opening at the top or in the side, or both. Hot combustion air is forced through tuyeres extending through the walls of the cylinder at a point close to but spaced from the bottom. The oxygen in the air burns the coke creating heat which melts both the scrap and the flux. The hot gases pass upwardly and are exhausted through ducts communicating with the top of the cylinder. Molten metal and molten flux combined with molten coke ash, now called slag, drip down into the bottom of the cupola and then flow through a passage at the bottom of the cylinder into various receptacles such as a forehearth from which the molten metal is drawn off from time to time and cast into metallic shapes. The molten slag is drained away as it accumulates and is discarded.

In the cupola, the oxygen of the combustion air reacts with the carbon of the coke in an exothermic reaction to produce $CO_2$ and heat. This heat heats the nitrogen of the air. The hot gases flow upwardly through the cupola heating the incoming charge consisting of metal, coke and flux. Once all of the oxygen in the combustion air is consumed, part of the resultant carbon dioxide passing upwardly through the hot coke, is itself reduced to carbon monoxide in an endothermic reaction with the ultimate ratio of carbon monoxide to carbon dioxide being dependent upon the gas and coke temperatures. This mixture of hot carbon monoxide, carbon dioxide, and nitrogen then passes out of the top of the cupola where the carbon monoxide is burned to carbon dioxide in an exothermic reaction and the heat of the gases of combustion are preferably transferred to the incoming combustion air through a heat exchanger.

Combustion air is introduced into the cupola through tuyeres which may consist of several spaced rows so that as the oxygen in the air introduced through the lower row of tuyeres is consumed, a fresh supply of oxygen will be introduced so that for over a considerable vertical distance in the cupola there is an exothermic reaction taking place. The metal and flux normally melt in this combustion zone.

It is also known to introduce a quenching medium into the cupola above the upper row of tuyeres. Such quenching medium may be water or a hydro-carbon fuel. The effect of it is to lower the effective temperature in the cupola resulting in a lowering of the ratio of carbon monoxide to carbon dioxide due to the lower temperature in the cupola. The heat absorbed by the quenching medium is recovered subsequently and transferred to the incoming combustion air in the heat exchangers.

Coke for use in cupolas is produced by heating coal in closed retorts which boil or burn off the volatile vapors leaving pure carbon plus some ash in various sized lumps or pieces. Only the larger pieces of the coke can be used in a cupola because of the necessity for maintaining open passages through the cupola charge through which the combustion air can be forced. The smaller pieces of coke called "coke breeze" tend to block up these air passages and cannot be employed. Thus, coke breeze normally has relatively little value for cupola operation and is either sold at considerably reduced prices or dumped. This is an economic waste.

A problem with cupolas has been that it is difficult or expensive to shut down the melting of metal for short or extended periods of time unless the operator continues feeding the large expensive coke into the cupola and continues burning it even though no scrap steel is being melted.

Still a further difficulty with cupolas has been that of maintaining the cupola bottom and its forehearth heated, particularly when no new scrap is being melted which scrap as it melts carries heat into the bottom of the cupola and then into the forehearth. Should the bottom or forehearth ever cool, the removal of the hardened iron and slag therein is a very expensive and time consuming task.

Another problem with cupolas has been the problem of air pollution in the form of emissions or particulates, e.g. fly ash carbon, cinders and/or soot which must be removed from the exhaust gases by means of precipitators, filter bags or the like all of which are expensive both capital wise and to operate.

A still further problem with cupolas has been that in their design, the overall minimum height of the cupola required to melt a given weight of metal per unit cross sectional area of the cupola is limited by the rate of heat production and the stock travel rate, which are locked together, the greater the rate of heat production the greater the stock feed rate. To insure that each piece of metal in the feedstock was exposed to the heat for a sufficient length of time so as to be heated all the way through and melted, the cupola had to have a certain minimum height. Alternatively the maximum size of each piece of metal feed stock had to be limited.

In accordance with the present invention a relatively conventional cupola for melting pieces of metal scrap is provided comprised of a vertical refractory-lined cylinder, a refractory lined forehearth at the bottom for receiving molten steel as it is melted through a cupola discharge opening, means at or adjacent to the top for feeding in a mixture of metal, coke, and flux, tuyeres spaced from the bottom for injecting preheated combustion air into the mixture of coke, metal, and flux, all in combination with a hot gas generator arranged to inject hot, carbon monoxide rich gases into the cupola cylinder below the tuyeres and preferably through the forehearth and through the cupola discharge opening.

The hot gas generator may take a number of different forms but preferably comprises a closed vertical, refractory-lined steel cylinder having an outlet opening at the bottom communicating with the cupola hearth through the forehearth, an inlet at or adjacent to the top for feeding in a carbonaceous fuel and a plurality of rows of vertically-spaced tuyeres spaced from the bottom for injecting combustion air into the gas generator. The carbonaceous fuel may be in the form of coal and/or coke, the coke being in any desired form or size, e.g. coke breeze and/or the large lumps. The hot gas generator runs continuously and discharges heated gases, namely a mixture of nitrogen, carbon dioxide and carbon monoxide all having a temperature preferably on the order of 2700° to 3000° Fahrenheit into the forehearth and then into the bottom of the cupola. These gas temperatures may be further raised by injecting air and/or oxygen into the gas stream to burn some of the carbon monoxide to carbon dioxide in an exothermic reaction. This gas generator thus serves as a source of heat not only due to the temperature of the gases but also, when the CO reaches the tuyeres of the cupola, due to the exothermic reaction as the CO burns to $CO_2$.

An important part of the gas generator is that the flow of the principal portion of the gases is downwardly through the generator and the bottom of the generator is always at a temperature such that any coke ash, or flux, or other nonmetallics fed into the top of the generator will be melted and can be removed as a molten slag. The hot gases entering the hearth and/or the bottom of the cupola can thus be free or substantially free of any particulates. If such particulates are present, they are trapped by the hot coke, metal and slag in the bottom of the cupola and melted. At any rate, they are filtered out in the mass in the cupola and thus are not a pollution problem. Additionally, any hydrocarbons present in the fuel fed to the generator will be cracked and/or burned.

For a given total weight of coal and/or coke used to melt a given weight of iron, the potential pollution creating possibilities are reduced.

The gas generator can also be used as a source of heat for other heat using apparatus, e.g. boilers which today are direct fired with natural gas, methane or coal.

To carry out this phase of the invention, the generator must have a bottom gas discharge temperature above the melting point of the slags or ashes (or iron) present in the feed stock to the generator. Such ashes normally have melting temperatures above 2000° F. (1100° C.) and thus in accordance with the invention the lower outlet temperature of the gas must be above such temperatures.

The silicon dioxides have melting temperatures varying between approximately 2880° F. (1600° C.) and 3060° F. (1700° C.) while the silicates, e.g., sodium silicate, has a lower melting temperature of, e.g., 1958° F. (1088° C.). Aluminum silicate has a melting temperature of 3456° F. (1920° C.). If limestone is included as part of the feed stock, the resultant calcium oxide which melts at 3240° F. (2580° C.) forms an eutectic with the ashes having substantially lower melting temperatures.

To obtain such high temperatures, the combustion air to the generator tuyeres must be preheated and normally fed into the generator at several vertically spaced points. Also, oxygen enriched air or pure oxygen may be used to supplement the regular combustion air or may be injected into the bottom of the generator or into the forehearth or into the passage to the forehearth.

For a straight gas generator, a plurality of vertically-spaced rows of tuyeres are provided starting from a point spaced slightly above the discharge opening located in the lower part of the vertical cylinder. The amount of hot combustion air injected through the lower rows is so controlled as to produce a maximum ratio of CO to $CO_2$ at the bottom of the cylinder and an exiting temperature of all the gases above the melting temperature of the slags which are formed in the generator.

It will be appreciated that coke and/or limestone being fed into the gas generator from the top contain certain amounts of moisture and in accordance with the invention, a small amount of the hot gases of combustion in the generator are caused to flow upwardly through the generator and exhausted from the top of the gas generator through a closed supply chamber for such coke and/or limestone located on the top of the generator. The effect of the hot gases is to dry the down moving feed stock to the generator. These gases are then fed to combustion air preheaters and/or exhausted to the atmosphere.

It is possible to feed into the gas generator steel chips, turnings or the like which cannot be normally effectively melted in a cupola as disclosed in U.S. Pat. No. 3,186,830. Because the gases in the gas generator, except around the tuyeres, are principally carbon monoxide and nitrogen, they are essentially reducing gases and oxidation of the steel chips does not occur. These steel chips are then melted down by the heat of combustion and flow into the forehearth where the molten metal mixes with the molten metal from the cupola. By controlling the metallurgy of the steel being fed into the gas generator, it is possible to alter the metallurgy of the molten metal in the forehearth while at the same time providing hot CO rich gases to the cupola.

In accordance with an alternative aspect of the invention, iron oxide in the form of iron ore, or mill scale, can be fed into the generator along with the coal or coke and limestone. In such case, in an intermediate zone between the upper tuyeres and the lower tuyeres, CO rich gas is held at a temperature of approximately 1500° Fahrenheit and recirculated to reduce the iron oxide to sponge iron which is then subsequently melted in the lower zones of the generator which zones are raised to higher temperatures by the injection of additional hot combustion air through the lower tuyeres. The generator can thus provide fresh molten metal to the forehearth along with hot CO rich gases to the cupola.

The principal object of the invention is the provision of a new and improved cupola system which is relatively simple and which enables a substantial reduction in the amount of coke used in a cupola for melting a given amount of metal.

Another object of the invention is the provision of a new and improved cupola gas generator arrangement wherein for a given amount of metal melted, there will be less particulate pollutants dispensed into the surrounding atmosphere.

Another object of the invention is the provision of a new and improved cupola arrangement including an auxiliary gas generator which generator can utilize coke breeze as a fuel.

Still another object of the invention is the provision of a new and improved cupola-gas generator arrangement which enables the cupola to be shut down while still keeping the cupola and its forehearth hot so that operation of the cupola can be restarted at any time.

Another object of the invention is the provision of a new and improved gas generator for generating hot gases to be used as a source of heat in a cupola or in other heat using equipment.

Another object of the invention is the provision of a new and improved gas generator arrangement for use with cupolas wherein a portion of the hot gases generated are bled upwardly through the incoming raw materials to the generator whereby to preheat and dry same before they enter the principal combustion zone of the generator, thereby eliminating generation of hydrogen gases lower down in the generator, in part coking any coal present.

Another object of the invention is the provision of a new and improved cupola-gas generator arrangement wherein hot gases from the generator arrangement are fed to the cupola through the cupola bottom and forehearth thereby keeping previously melted metals in a properly heated condition.

Another object of the invention is the provision of a new and improved generator for producing hot gases from coal or coke particularly for use with cupolas or other heat using equipment which generator produces a minimum of or no particulate emissions.

Another object of the invention is the provision of a new and improved cupola-hot gas generator combination which enables the stock feed rate to be substantially reduced.

Another object of the invention is the provision of a new and improved cupola-hot gas generator combination which enables the overall height of the cupola to be substantially reduced while still maintaining the same meltdown rate per unit cross sectional area of the cupola.

The invention may take physical form in certain parts and arrangements of parts and certain steps and combinations of steps, preferred embodiments of which will be described in detail in this specification and illustrated in the accompanying drawing which forms a part hereof and wherein:

FIG. 1 is a somewhat schematic view of a cupola-forehearth-gas generator arrangement, all illustrating a preferred embodiment of the invention.

Referring now to the drawings wherein the showings are for the purpose of illustrating a preferred embodiment of the invention only and not for the purpose of limiting same, FIG. 1 shows a relatively conventional metal melting cupola A discharging into a relatively conventional forehearth B, all in combination with a hot gas generator C arranged to discharge hot gases containing CO through the forehearth B into the lower end of the cupola A.

Cupola A as indicated is relatively conventional and includes a vertically-extending, refractory-lined, steel cylinder 10 having at the lower end a refractory lined discharge passage 11 sloping generally towards the forehearth B. Two vertically spaced rows of water cooled tuyeres 13, 14 extend through the walls of the cylinder 10 with the lowermost row being spaced slightly above the cupola bottom and the discharge opening 11. These tuyeres 13, 14 are supplied from a pair of wind drums 15, 16 surrounding the cylinder 10 and connecting through duct work 18 and cupola blast balancing controls 20 to air preheaters (not shown) and large motor-driven blowers (also not shown). Valves V-13, V-14, between each wind drum 15, 16 and the respective tuyeres 13, 14 control the amount of air flowing therethrough, all as is conventional.

The cupola blast balancing controls, while important to the operation of the cupola, form no part of the present invention and as shown include metering orifices 21 and a main control valve 22.

The upper end of the cupola cylinder 10 is fitted with a below charge gas take-off section 24 of generally larger diameter than the cylinder 10. A cylindrical charge feed cylinder 28 open at the top extends coaxially into the below charge gas take-off section terminating at its lower end at a point generally spaced from the upper end of the cylinder 10. An exhaust duct 26 communicates with the take-off section 24 and in turn communicates to a (not shown) conventional gas cleaning system and/or combustion air preheaters.

A relatively conventional material charging bucket 30 is shown in position above the charging cylinder 28 and in operation functions to charge the cupola with scrap steel, coke, and limestone, either as a mixture or in successive charges. Obviously conventional side feeding of the cupola can be employed if desired.

The outside of the cupola cylinder 10 at the upper end is provided with a plurality of water cooling spray nozzles 32 which flow water onto the outer side of the cylinder 10 and this water is collected in a water cooling collection trough 34 positioned at the lower end of the cylinder 10.

The forehearth B may take any one of a number of different forms but in the embodiment shown includes a refractory lined steel cylinder 40 with the passage 11 from the cupola cylinder 10 feeding into its upper end and having a discharge passage 41 located at the bottom communicating with a slagging spout 42 from which molten metal can be continuously withdrawn. As shown, the slagging spout 42 has a slag baffle 43 which skims off any slag on the top of the metal and this slag is drawn off through a side channel 45 and thrown away.

The forehearth B further includes a gas tight cover 44 on the upper end such that the cylinder 40 along with its bottom closure wall forms a gas tight chamber 46 opening to the cupola cylinder 10 in which molten metal 47 with a slag layer 48 on top can collect and be then forced through the pasage 41 into the slagging spout by means of varying the gas pressure in the chamber 46. This pressure as will appear is controlled by adjusting the volume and pressure of the combustion air flowing both into the cupola A and into the gas generator C.

The gas generator C in the preferred embodiment, in a manner similar to the cupola, consists of a vertically-extending, refractory-lined steel cylinder 50 having a passage 51 at the lower end communicating with the chamber 46 of the hearth B. In a manner similar to the cupola A, the gas generator C is provided with a plurality of water cooling sprays 54 which spray cooling water on the outside of the steel cylinder which water then flows down the outside of the cylinder and is collected in a water collection trough 56 positioned at the lower end of the generator C.

The gas generator, in the embodiment shown, is provided with one or a plurality of rows of upper tuyeres 58 (only one row being shown) which communicate through duct work 59 and control valves 60 to a wind drum 61 which in turn communicates through large motor driven blowers to preferably air preheaters. These preheaters are in turn heated by the heat in the exhaust gases from the cupola A as is conventional. These tuyeres 58 are used primarily when the generator C is being used to melt steel scrap or reduce iron oxides.

The gas generator C is also provided with a plurality of rows of lower water cooled tuyeres. In the embodiment shown there are four such rows 62, 63, 64, 65. More or less can be employed. These tuyeres communicate through valves indicated generally by the numeral 66 and duct work 67 with the wind drum 61 which as before pointed out communicates through large motor driven blowers (not shown) to air preheaters (not shown).

When the generator is to be used to reduce iron oxide, a recycling arrangement is preferably provided. Thus, intermediate the upper row 58 of tuyeres and the upper row 62 of the lower tuyeres, a gas take-off bustle 70 is provided communicating through circumferentially spaced openings 71 in the wall of the generator C to the inside thereof which gas take-off bustle 70 in turn communicates through duct work 73 with recycle fan or pump 74 the output of which communicates through a gas injection bustle 75 to a plurality of circumferentially spaced ports 76 in the wall of the gas generator C. The ports 71 are located just above the upper row 62 of the lower tuyeres while the ports 76 are located just below the upper row 58 of tuyeres.

It will be appreciated that as the recycle fan or pump 74 operates, hot CO rich gases are drawn from the inside of the gas generator C into gas take-off bustle 70 at a point spaced above the upper row 62 of the lower tuyeres and this hot gas is then reinjected back into the gas generator C through gas injector bustle 75 at a point spaced vertically upwardly from the gas take-off bustle 70 but below the upper row of tuyeres 58. These bustles and the recycle fan are used primarily when the gas generator C is being used to reduce iron oxide in which case they recirculate CO rich gases at a temperature of approximately 1500° C. to heat any iron oxide in the space between the take-off and injection bustles in a reducing atmosphere to reduce any iron oxide present to sponge iron. This sponge iron is then melted in the lower portions of the generator C as will appear.

The upper tuyeres 58 are primarily of value when the generator is being used to melt steel chips or turnings or for reducing iron ore. In the event the generator C is being used only for hot gas generation, the upper tuyeres and/or the gas take-off arrangement 70–76 may be omitted.

Coal and/or coke and limestone ($Ca\ CO_3$) are fed into the gas generator C through an inlet opening 80 in the upper end thereof from a drying chamber 81 the upper end of which communicates through a material feeding gas seal valve 82 to a feed hopper 83. This drying chamber may if desired also be used to feed iron ore and/or steel chips into the gas generator C if the gas generator C is to be used for the purpose of reducing iron ore or melting steel chips.

The upper end of the drying chamber 81 communicates to a gas cleaning system through a gas by-pass duct 85, a control valve 86, a further duct 87, a second control valve 88 and thence to the duct which as previously pointed out communicates to the quencher and large motor driven gas blowers. The purpose of this last mentioned set of duct work is to allow hot gases to pass upwardly through the drying chamber for the purpose of drying any coal or coke, iron ore, or steel scrap which is to be fed into the gas generator C. It will be appreciated that if this moisture is not removed, it will disassociate under the high temperatures in the gas generator C consuming heat, reducing temperatures and introduce hydrogen, which is undesirable, into the molten steel in the forehearth B.

A tuyere 90 is provided into the passage 51 for the purpose of injecting oxygen or oxygen enriched air into the hot gases flowing from the gas generator C to forehearth B to further heat the same.

To describe the operation of the cupola A, the forehearth B, and the gas generator C, it will be assumed that each have reached a steady state operating condition. Thus, it will be assumed that the cupola is loaded with a mixture of coke, scrap metal, and limestone ($Ca\ CO_3$) from its lower end to a point close to the top of the feed tube 28 and is at operating temperature.

The length of the feed tube 28 will be referred to as the charging zone D. The length of the cupola A from the bottom of the feed tube 28 to a point just above the upper row of tuyeres 13 will be referred to as the preheat zone E; from the lower end of the preheat zone E to the lower row of tuyeres 14 will be referred to as the combustion zone F and the zone below the combustion zone F will be referred to as the melting zone G.

In operation, the gas generator C is normally filled with a continuous column of coal and/or coke (coke breeze) and limestone ($Ca\ CO_3$); and when used as a reducing furnace, iron ore; and when used as a supplementary supply of steel, steel chips or the like.

In the gas generator C the length of the drying chamber 81 extending into the upper end of the gas generator C will be referred to as the drying zone J and from the lower end of the drying zone J to a point just below the upper row of tuyeres 58 will be referred to as the first combustion zone K. The zone from the lower end of the first combustion zone K to the upper row 62 of the lower set of tuyeres will be referred to as the reducing zone L and the zone from the lower end of the reducing zone L to the lower end of the generator C will be referred to as the second combustion zone M.

In operation, the charging zone D of the cupola A will have a temperature variation from the top of ambient to approximately 830° C. at the lower end. The preheat zone E will have a temperature from approximately 830° C. at the upper end to 1300° to 1800° C. at the lower end. The combustion zone F will have a temperature on the order of 1350°–1800° C. The melting zone G will have a temperature of approximately 1350° to 1800° C. and the molten slag and molten steel running into the forehearth B will have similar temperatures.

When the gas generator C is used for reducing iron ore or melting steel chips, the drying zone J will have a temperature variation from approximately ambient at the top to around 830° C. at the lower end and the first combustion zone K will have a temperature variation from approximately 830° C. at the top to 1350°–1800° C. at the lower end. The reducing zone L will have a temperature varying from approximately 1350°–1800° C. at the upper end to approximately 830° C. at the lower end, that is, just above the upper row of tuyeres 62. The second combustion zone M will have a temperature variation increasing from approximately 830° C. at the upper end to 1350°–1800° C. at the lower end.

In operation, it will first be assumed that the gas generator C is being used solely for the purpose of generating a mixture of carbon monoxide and nitrogen at elevated temperatures which are to be fed through the forehearth B to the melting zone G of the cupola A. Approximately 55 cfm of air under pressure at 425° C. is fed through the lower tuyeres 62, 63, 64, 65 into the second combustion zone M where the oxygen of the infed air combines with the carbon of the coke to form carbon dioxide in an exothermic reaction which raises the temperature of the carbon dioxide, nitrogen, and coke to approximately 1800° C.

A small portion of these hot gases flows upwardly through the coal or coke in reduction zone L; first combustion zone K, and drying zone J. This gas is rapidly cooled by giving up its heat to the coal or coke such that there is very little reduction of the carbon dioxide back to carbon monoxide. This hot gas preheats the coal or coke in these zones to a temperature in excess of 100° C. such that any water vapor in the coal or coke in the drying zone J is evaporated and passes upwardly and is exhausted through duct 85.

The remainder of the hot gases in the second combustion zone M flows downwardly through the incandescent bed of coke and the carbon dioxide in the downflowing gases is then reduced to carbon monoxide in an endothermic reaction such that the temperature of the gases are reduced slightly to around 1370° C. The gases flowing from the generator into the forehearth B are approximately 35% carbon monoxide and 65% nitrogen.

Preferably, oxygen in amounts of approximately 4% of the air input to the gas generator C is injected through tuyere 90 into this stream of gases as it passes through passage 51 connecting the bottom of the gas generator C with the forehearth B. Some of the CO is burned to carbon dioxide in an exothermic reaction such that the temperature of the gases flowing into the forehearth B will be raised to approximately 1800° C. These gases keep the forehearth B at an elevated temperature and make up for the heat loss of the forehearth B due to radiation or the like.

The gases flowing into the forehearth B are comprised essentially of 65% nitrogen, 32½% carbon monoxide, and 2½% carbon dioxide at approximately 1850° C. These hot gases then flow through the passage 11 communicating the forehearth B with the lower end of the cupola A and as will appear form a substantial source of heat for the cupola A. As these gates enter the cupola A, they come into contact with the incandescent coke at the bottom thereof, i.e. in the melting zone G and the carbon dioxide is again reduced to carbon monoxide in an endothermic reaction. There is thus available at this point a heat source which consists of the latent heat of combustion of the carbon monoxide as well as the heat content of the hot gases themselves. These gases then flow upwardly through the cupola A to the combustion zone F. Here 34 cfm of combustion air is supplied through the tuyeres 14 at approximately 425° C. this air having previously been preheated in preheaters not shown. Also, 34 cfm of air at ambient temperatures is supplied through tuyeres 13. Obviously, preheated air could be used here. The oxygen of the injected air reacts both with the carbon monoxide from the gas generator C and with the carbon of the coke in the cupola A in an exothermic reaction. The temperature in the vicinity of these tuyeres reaches approximately 1800° C. Such temperatures, of course, melt the scrap iron which has been fed into the top of the cupola A as well as calcine the limestone to drive off the carbon dioxide and any moisture leaving calcium oxide which melts at this temperature and flows downwardly with the molten iron into the forehearth B.

In the upper parts of the combustion zone F, the gases consist of approximately 65% nitrogen and 35% carbon dioxide. These hot gases then pass upwardly into the preheat zone E where they preheat the scrap iron, coke, and limestone which is being constantly fed into the top of the cupola A. As these hot upflowing gases come in contact with the downflowing coke, some of the carbon dioxide reacts with the coke and is reduced in an endothermic reaction to carbon monoxide. The amount of reaction depends on the temperature in this zone E, the higher the temperature the higher the percentage of carbon monoxide.

Although it forms no part of the present invention, in some instances hydrocarbons or even water vapor can be injected into the cupola A above the tuyeres 13, 14 to reduce the temperature of the gases flowing upwardly in the cupola such that the amount of carbon dioxide reduced to carbon monoxide will be reduced.

These gases then continue to flow upwardly through the cupola and are exhausted from the top through duct 26. Subsequently, any carbon monoxide in these exhaust gases is burned back to carbon dioxide and the resultant heat content of these hot gases is recovered through conventional heat exchangers (not shown) to preheat the incoming air to the cupola A and the gas generator C.

It is to be noted that a substantial portion of the heat input to the cupola A comes from the heat content of the hot gases and latent heat of combustion of the carbon monoxide of the gases coming from the gas generator C. For this reason, the ratio of coke to scrap metal being fed into the top of the cupola can be substantially reduced.

Inasmuch as the coke which must be fed into the top of the cupola is of the highest grade, this reduction in the ratio of coke to scrap metal results in a substantial saving in the cost of operation inasmuch as the coke or coal which is fed into the gas generator C can be of a far cheaper grade. In fact, the gas generator C can employ what is known as coke breeze which is otherwise of no commercial value. Various substantial savings in operational costs can result.

A further advantage in the reduction of the ratio of coke to metal used in the cupola is a reduction in the stock travel rate which results in each piece of metal above the tuyeres being exposed to the hot gases for longer periods of time. Thus, for a given maximum size piece of metal in the feedstock, the overall height of the cupola may be reduced. Alternatively, for a given height of cupola, larger pieces of metal may be melted because for such a given sized cupola, the metal pieces are subjected to the heating process for longer periods of time and thus melting of all such pieces can be assured. Further, by varying the heat input rate from the generator C, the stockfeed rate in the cupola can be correspondingly varied.

This reduction in the stock travel rate in the cupola, which can be as much as 80%, is particularly advantageous where the cupola is to be used for the reduction of pelletized iron ore by reaction with carbon wherein each pellet must be exposed to the heat of the cupola for a period long enough to enable complete reduction of all of the iron oxide before the pellets have reached the combustion zone adjacent the tuyeres.

It will be appreciated that there are heat losses from the gas generator C, the forehearth B, and the cupola A either due to radiation or that carried away by the cooling water on the walls of the cupola A and gas generator C. In addition, there will be a heat loss in the gases passing out of the top of the gas generator C some of which cannot generally be recovered. Also there is a substantial heat content in the gases flowing out of the top of the cupola A some of which can be recovered in the heat exchangers for the incoming combustion air.

In accordance with the invention, the gas generator C may also be employed for the purpose of reducing iron oxide in the form of mill scale or iron ore or for melting steel chips. In such instances, hot combustion air is fed into the gas generator C into the first combustion zone K through the tuyeres 58 where the carbon of the coke reacts with the oxygen of the air in an exothermic reaction to produce carbon dioxide, nitrogen, and substantial amounts of heat. As before, a small portion of this gas is fed upwardly through the drying zone J and is exhausted from the upper portions of the gas generator C and handled as before described.

The remaining portions of the hot gases feed downwardly through the gas generator C where the carbon dioxide in contact with the hot coke is is immediately reduced to carbon monoxide in an endothermic reaction. Preferably the amount of hot gases being fed into this first combustion zone is such that these gases will be reduced to a temperature of approximately 1500° C. As these gases flow downwardly, portions are withdrawn from the generator C through the ports 71 just above the second combustion zone M which gases are then passed through the recycle fan 74 and reinjected into the gas generator C through tuyeres at a point just below the first combustion zone K. The iron ore or iron oxide and coke in this zone L is thus at a temperature of 830° C. The oxygen of the iron oxide combines with the carbon of the coke to produce carbon monoxide which latter continuously flows down through the gas generator C until it reaches the second combustion zone where the preheated combustion air is fed into the tuyeres 62, 63, 64, and 65 with a corresponding exothermic reaction and an increase of temperature in the gas generator C to 2400° C. This temperature is sufficient to melt the iron which has been produced by the reduction of the iron ore in the reduction zone and this iron melts and flows into the forehearth B through the passage 51.

Steel chips may likewise be treated in the gas generator C and because of the continued presence of the reducing atmosphere within the gas generator C, these steel chips are heated to the melting temperature without being subjected to the oxidizing process which would occur if steel chips were fed into the cupola A. By controlling the alloy of the chips or adding alloying ingredients to the iron ore or chips, it is possible to add alloying ingredients to the molten metal in the forehearth B.

Having described our invention, we claim:

1. In combination; a cupola having means adjacent the upper end for infeeding of pieces of metal, coke, and flux, a plurality of tuyeres spaced above the bottom, and a molten metal and slag discharge passage at the bottom; a closed forehearth communicating with the outlet of said passage; a gas generator having normally closed means for infeeding at least carbon containing materials at the upper end, a passage at the lower end communicating with said forehearth, and a plurality of vertically spaced rows of tuyeres with the lowermost row being spaced from the lower end; and means for injecting preheated combustion air through the tuyeres of said generator and said cupola, whereby hot gases from said generator including carbon monoxide pass through said forehearth into the lower end of said cupola to provide an additional source of heat for said cupola due to the heat content of said hot gases and the combustion heat of carbon monoxide.

2. The apparatus of claim 1 wherein said gas generator has additional tuyeres adjacent the upper end thereof spaced from the first mentioned tuyeres of said generator and means for withdrawing hot gases from said generator from a point spaced above said first mentioned tuyeres and reinjecting same at a point below said last mentioned tuyeres whereby iron oxide can be infed to said generator and reduced.

3. The apparatus of claim 1 wherein said gas generator has a drying zone above the uppermost row of tuyeres and means for exhausting a portion of the hot gases on the inside of said generator through said zone whereby to dry any incoming feedstock.

4. In combination, a cupola having means adjacent the upper end for infeeding of pieces of metal, coke, and flux, a plurality of tuyeres spaced above the bottom, and a molten metal and slag discharge passage at the bottom; a gas generator having normally closed means for infeeding at least carbon containing materials at the upper end, a passageway at the lower end communicating with the interior of said cupola at the bottom thereof spaced below the said tuyeres, and a plurality of vertically spaced rows of tuyeres with the lowermost row being spaced from the lower end; and means for injecting preheated combustion air through the tuyeres of said generator and said cupola, whereby hot gases from said generator at a temperature of at least 1370° C. and of rich carbon monoxide content pass through said passageway and into the bottom of said cupola below the tuyeres thereof to provide an additional source of heat input to said cupola due to the heat content of said hot gases and the latent heat of combustion of the carbon monoxide thereof.

5. The combination of claim 4 including means for injecting oxygen into said passageway whereby to burn at least a portion of the carbon monoxide in the said hot gases passing therethrough to the cupola so as to raise their temperature.

* * * * *